US006137045A

United States Patent [19]

Short et al.

[11] Patent Number: 6,137,045

[45] Date of Patent: Oct. 24, 2000

[54] METHOD AND APPARATUS FOR COMPRESSED CHAOTIC MUSIC SYNTHESIS

[75] Inventors: Kevin M. Short, Durham, N.H.; Dan Hussey, Bloomington, Ind.; Kimo Johnson, Orange, N.H.

[73] Assignee: University of New Hampshire, Durham, N.H.

[21] Appl. No.: 09/437,565

[22] Filed: Nov. 10, 1999

Related U.S. Application Data

[60] Provisional application No. 60/107,937, Nov. 12, 1998.

[51] Int. Cl.[7] ..... G10H 7/00

[52] U.S. Cl. ..... 84/603; 84/622

[58] Field of Search ..... 84/603, 622

[56] References Cited

U.S. PATENT DOCUMENTS 5,508,473 4/1996 Chafe .

5,606,144 2/1997 Dabby .

*Primary Examiner*—Jeffrey Donels

*Attorney, Agent, or Firm*—Paul C. Remus, Esq.; Kristin Kohler, Esq.; Devine, Millimet & Branch, Professional Association

[57] ABSTRACT

A new method and apparatus for music synthesis is provided. A chaotic system is driven onto a periodic orbit by a compressed initialization code. A one-dimensional, periodic waveform is then produced from the periodic orbit. A variety of periodic orbits produces a variety of sounds, which sounds approximate the sounds of different musical instruments. By sampling the amplitude of the periodic waveforms over time, a digital version of the sound is produced. The frequency and duration of a note to be synthesized are produced by sampling the periodic waveform at the proper rate to produce the desired frequency and then repeating the waveform to produce a note of the required duration.

8 Claims, 4 Drawing Sheets

METHOD AND APPARATUS FOR COMPRESSED CHAOTIC MUSIC SYNTHESIS

STATEMENT OF RELATED CASES

This application claims the benefits of U.S. Provisional Application No. 60/107,937, filed Nov. 12, 1998.

FIELD OF THE INVENTION

The present invention relates generally to a method and apparatus for music synthesis. More specifically, it relates to a system for controlling a chaotic system to produce musical waveforms. More specifically still, it relates to a system for controlling the chaotic system with a compressed initialization code.

BACKGROUND OF THE INVENTION

The use of chaotic systems, particularly in communications, is a rapidly developing field of research. In general, a chaotic system is a dynamical system which has no periodicity and the final state of which depends so sensitively on the system's precise initial state that its time-dependent path is, in effect, long-term unpredictable even though it is deterministic.

One approach to chaotic communication involves a chaotic system controlled by a transmitter/encoder and an identical chaotic system controlled by a receiver/decoder. Communication is divided into two steps: initialization and transmission. The initialization step uses a series of controls to drive the identical chaotic systems in the transmitter/encoder and receiver/decoder into the same periodic state. This is achieved by repeatedly sending a digital initialization stream to both chaotic systems, driving them onto a known, periodically repeating orbit. The necessary digital initialization stream contains less than 16 bits of information. The transmission step then uses a similar series of controls to steer the trajectories of the chaotic system to regions of space that are labeled 0 and 1, corresponding to the plain text of a digital message. In a preferred embodiment, the trajectories move around a two-lobed structure; one lobe is labeled 0, the other 1. The present invention uses the initialization step to produce known periodic orbits on chaotic systems, which are then converted into sounds that approximate traditional music notes.

The ability to drive a chaotic system onto a known periodic orbit, which is a closed loop in 3-dimensional space for a preferred embodiment, provides an entirely new method for music synthesis. By sending a compressed initialization code to the chaotic system, a periodic waveform can be produced that has a rich harmonic structure and sounds musical. The one-dimensional, periodic waveform needed for music applications is achieved by taking the x-, y-, or z-component (or a combination of them) of the periodic orbit over time as the chaotic system evolves. The periodic waveform represents an analog version of a sound, and by sampling the amplitude of the waveform over time, e.g., using audio standard PCM 16, one can produce a digital version of the sound. The harmonic structures of the periodic waveforms are sufficiently varied that they sound like a variety of musical instruments.

Most importantly, the periodic waveforms are produced using a compressed initialization code. Additional bits to determine the frequency and duration of a note to be synthesized are added to the initialization code to produce a compressed control code. In one embodiment of the present invention each note requires a control code of 32 bits of information.

It is an object of the present invention to control a chaotic system to produce musical waveforms. It is a further object to accomplish such control with a compressed initialization code.

SUMMARY OF THE INVENTION

A new method and apparatus for music synthesis is provided. A chaotic system is driven onto a periodic orbit by a compressed initialization code. A one-dimensional, periodic waveform is then produced from the periodic orbit. A variety of periodic orbits produces a variety of sounds, which sounds approximate the sounds of different musical instruments. By sampling the amplitude of the periodic waveforms over time, a digital version of the sound is produced. The frequency and duration of a note to be synthesized are produced by sampling the periodic waveform at the proper rate to produce the desired frequency and then repeating the waveform to produce a note of the required duration.

The foregoing and other objects, features and advantages of the current invention will be apparent from the following detailed description of preferred embodiments of the invention as illustrated in the accompanying drawings.

IN THE DRAWINGS

DETAILED DESCRIPTION OF THE INVENTION

Figure 1:
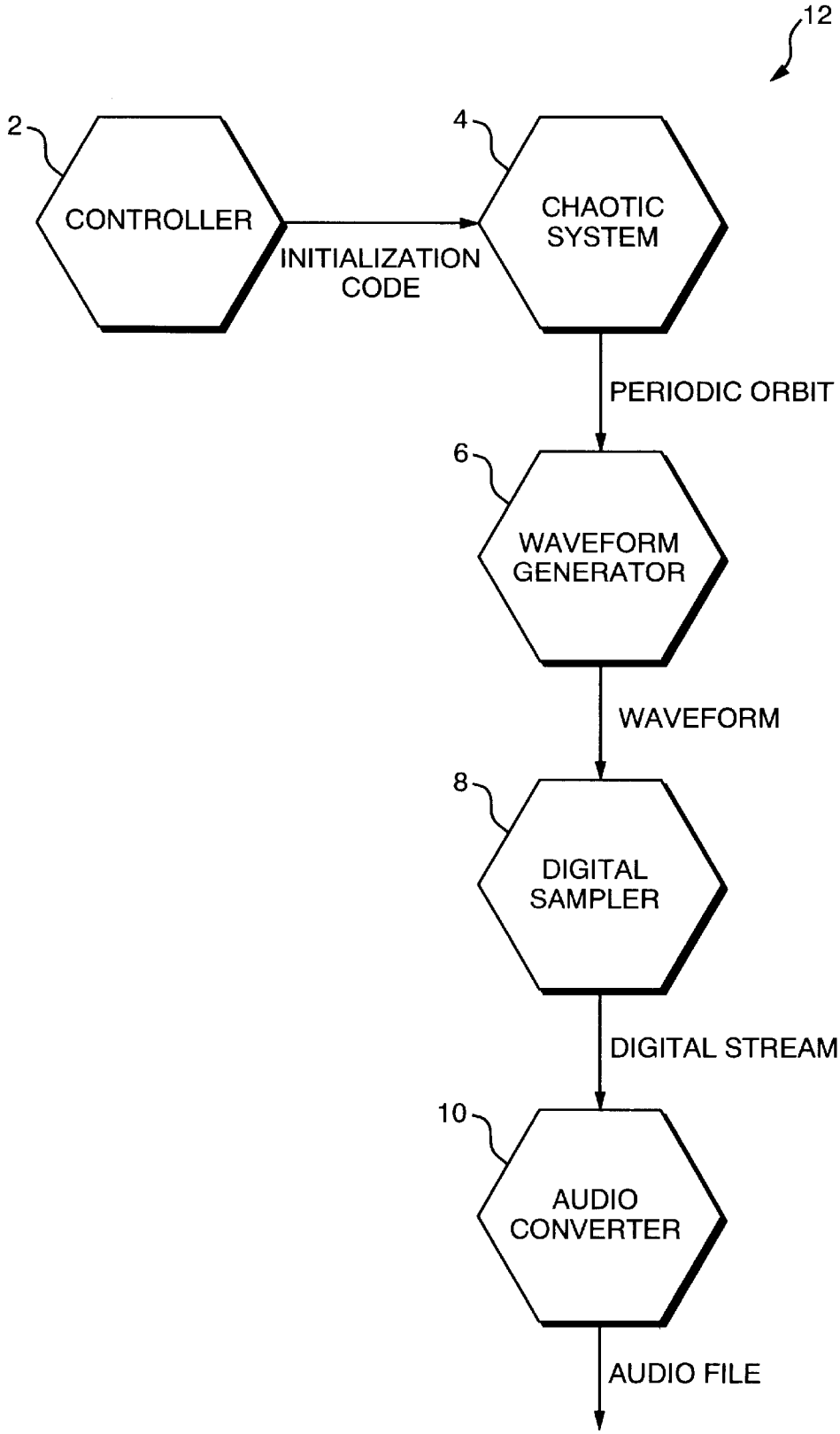
FIG. 1 is a block diagram of a compressed chaotic music synthesis system according to an embodiment of the present invention.

The present invention incorporates an entirely new method and apparatus for music synthesis involving a chaotic system. In its uncontrolled state, a chaotic system produces sounds not traditionally associated with music generation. The sounds can be described as warbling, where the pitch varies wildly and aperiodically.

However, a chaotic system has the desirable property that it generates numerous periodic orbits, each of which corresponds to a periodic waveform that has a differing harmonic structure. The corresponding one-dimensional, periodic waveform is produced by taking the x-, y-, or z-component (or a combination of them) of the periodic orbit over time. The difficulty is that these periodic orbits are unstable and the chaotic system drifts away from the periodicity so rapidly that the human ear cannot perceive anything but the warbling effect. If the chaotic system were left to evolve on its own, it would never settle onto a periodic orbit.

The present invention uses a compressed initialization code to drive a chaotic system onto a periodic orbit and to stabilize that orbit by the same code. The periodic orbit then produces a periodic waveform that has a traditional musical sound, since it includes the harmonic overtones that give different instruments their distinctive qualities. Consequently, instead of producing a single pitch (i.e., a sine wave) at the root frequency, as might be produced by a tone generator, the periodic orbit contains overtones at multiples of the root frequency. In a preferred embodiment of the present invention in which a double scroll oscillator is the chaotic system used, each periodic orbit corresponds to a periodic waveform with a natural harmonic structure that is related to the number of loops that take place around one lobe before moving off to the next lobe. Consequently, the variety of different periodic orbits produces a variety of sounds, which sounds correspond to different musical instruments. Thus, a group of initializing codes may produce periodic orbits that have the tonal qualities of a harpsichord; another group may produce periodic orbits that sound more like an electric guitar; another group may produce periodic orbits that sound like en electric piano, and so on. In a musical composition, if a note from a particular instrument is required, one simply selects an associated initializing code and uses it to stabilize the chaotic oscillator onto the corresponding periodic orbit.

It is important to note that, in a preferred embodiment of the present invention, the chaotic oscillator is generated by a few simple nonlinear differential equations and that the initializing code is merely a few bits of information (<16 bits in the double scroll embodiment). If one wishes to generate a note of CD quality, one needs to sample a musical waveform at 44,100 samples per second, so a note of duration one second would require 44,100 samples at 16 bits per sample, for a total of 705,600 bits of information for the note. Since the synthesizer (in the double scroll embodiment) involves only 3 simple differential equations and one can use these equations to collect data at any desired sampling rate, the musical tones generated by a chaotic compressed music synthesizer are CD-quality or better, and no losses are incurred in the production of the compressed music.

FIG. 1 shows a compressed chaotic music synthesis system 12 according to an embodiment of the present invention. A controller 2 imposes an initialization code on a chaotic system 4 to drive it onto a known periodic orbit. A one-dimensional periodic waveform corresponding to the periodic orbit is generated by the waveform generation 6. The amplitude of the periodic waveform is sampled by the digital sampler 8 by using one of a number of procedures known to those skilled in the art, e.g., using audio standard PCM 16. The audio converter 10 uses an audio conversion package to convert the output of the digital samples into a music file in a standard audio format, e.g., .au or .wav files.

Figure 2:
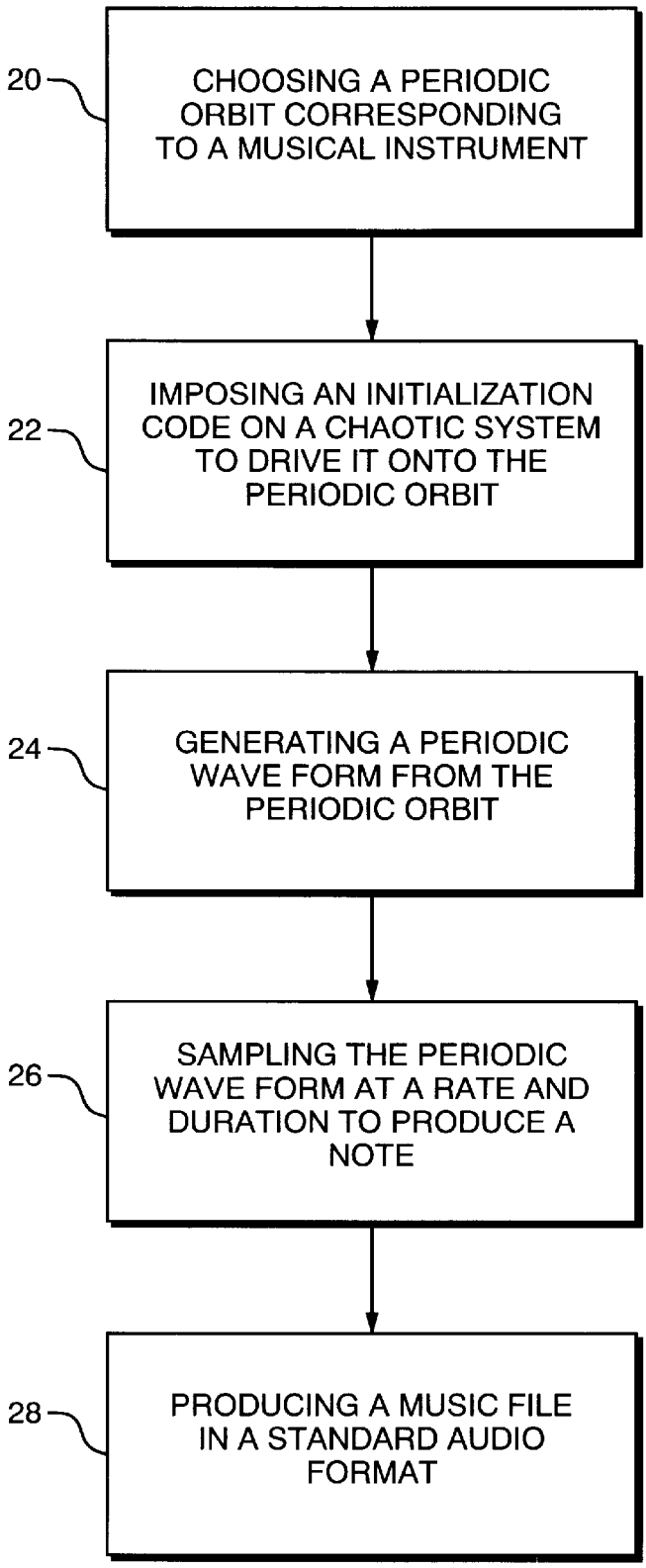
FIG. 2 is a flow chart showing the procedures of the compressed chaotic music synthesis system shown in FIG. 1.

FIG. 2 is a flow chart of the method and apparatus for compressed chaotic music synthesis of the present invention. The synthesis of a note from a musical instrument involves five steps, 20, 22, 24, 26 and 28. The first step 20 is choosing a periodic orbit on a chaotic system, which orbit corresponds to the desired musical instrument. There are a wide variety of periodic orbits on any one chaotic system, or periodic orbits from different chaotic systems may be used.

In a preferred embodiment, the chaotic system is a double-scroll oscillator [S. Hayes, C. Grebogi, and E. Ott, Communicating with Chaos, Phys, Rev. Lett. 70, 3031 (1993)], described by the differential equations $$C_1\dot{v}_{C1}=G(v_{C2}-v_{C1})-g(v_{C1})$$

$$C_2\dot{v}_{C2}=G(v_{C1}-v_{C2})+i_L$$

$$L\dot{i}_L=-v_{C2},$$

where $$g(v)=\begin{cases} m_1 v, & \text{if } -B_p \le v \le B_p; \\ m_0(v+B_p)-m_1 B_p, & \text{if } v \le -B_p; \\ m_0(v-B_p)+m_1 B_p, & \text{if } v \ge B_p \end{cases}$$

Figure 3:
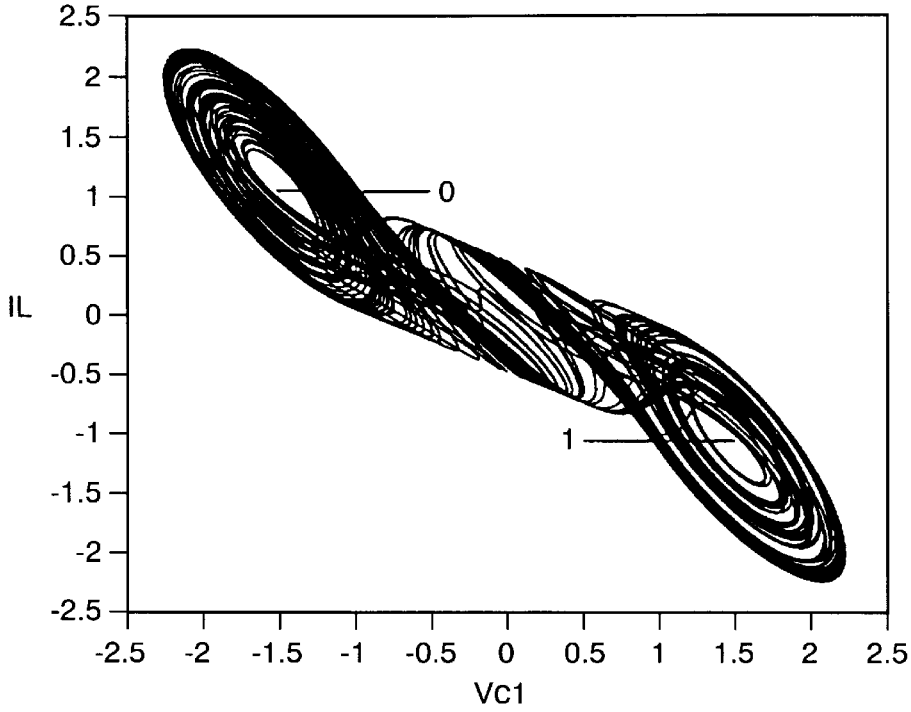
FIG. 3 is a plot of the double scroll oscillator resulting from the given differential equations and parameters.

The attractor that results from a numerical simulation using the parameters $C_1=1/9$, $C_2=1$, $L=1/7$, $G=0.7$, $m_0=-0.5$, $m_1=-0.8$, and $B_p=1$ has two lobes, each of which surrounds an unstable fixed point, as shown in FIG. 3.

Because of the chaotic nature of this oscillator's dynamics, it is possible to take advantage of sensitive dependence on initial conditions by carefully choosing small perturbations to direct trajectories around each of the loops of the oscillator. This ability makes it possible, through the use of a compressed initialization code, to drive the chaotic system onto the periodic orbit that is used to produce musical sounds.

Figure 4:
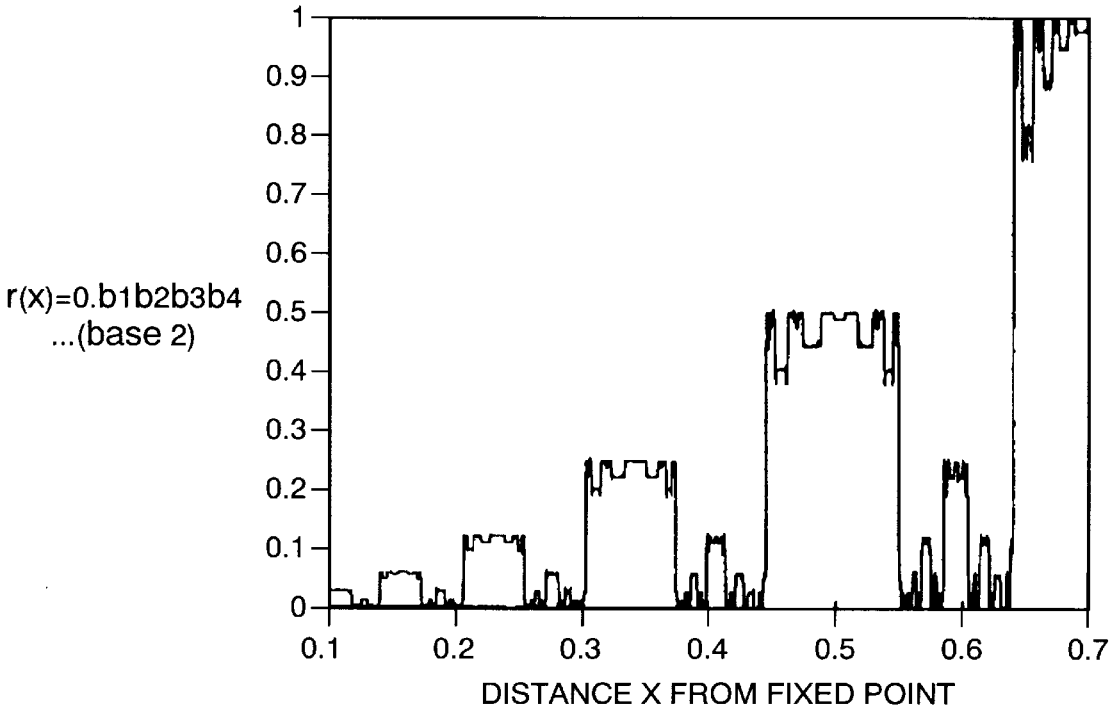
FIG. 4 is a plot of the function r(x) for twelve loops around the double scroll oscillator.

There are a number of means to control the chaotic oscillator. In a preferred embodiment, a Poincare surface of section is defined on each lobe by intersecting the attractor with the half planes $i_L=\pm GF$, $|v_{C1}|\leqq F$, where $F=B_p(m_0-m_1)/(G+m_0)$. When a trajectory intersects one of these sections, the corresponding bit can be recorded. Then, a function r(x) is defined, which takes any point on either section and returns the future symbolic sequence for trajectories passing through that point. If $\mathbf{1}_1, \mathbf{1}_2, \mathbf{1}_3, \ldots$ represent the lobes that are visited on the attractor (so $\mathbf{1}_i$ is either a 0 or a 1), and the future evolution of a given point $x_0$ is such that $x_0 \rightarrow \mathbf{1}_1, \mathbf{1}_2, \mathbf{1}_3, \ldots, \mathbf{1}_N$ for some number N of loops around the attractor, then the function r(x) is chosen to map $x_0$ to an associated binary fraction, so $r(x_0)=0.\mathbf{1}_1\ \mathbf{1}_2\ \mathbf{1}_3 \ldots \mathbf{1}_N$, where this represents a binary decimal (base 2). Then, when r(x) is calculated for every point on the cross-section, the future evolution of any point on the cross-section is known for N iterations. The resulting function is shown in FIG. 4, where r(x) has been calculated for 12 loops around the attractor.

Control of the trajectory can be used, as it is here, for initialization of the chaotic system and also for transmission of a message. Control of the trajectory begins when it passes through one of the sections, say at $x_0$. The value of $r(x_0)$ yields the future symbolic sequence followed by the current trajectory for N loops. For the transmission of a message, if a different symbol in the Nth position of the message sequence is desired, r(x) can be searched for the nearest point on the section that will produce the desired symbolic sequence. The trajectory can be perturbed to this new point, and it continues to its next encounter with a surface. This procedure can be repeated as many times as is desirable.

The calculation of r(x) in a preferred embodiment was done discretely by dividing up each of the cross-sections into 2001 partitions ("bins") and calculating the future evolution of the central point in the partition for up to 12 loops around the lobes. As an example, controls were applied so that effects of a perturbation to a trajectory would be evident after only 5 loops around the attractor. In addition to recording r(x), a matrix M was constructed that contains the coordinates for the central points in the bins, as well as instructions concerning the controls at these points. These instructions simply tell how far to perturb the system when it is necessary to apply a control. For example, at an intersection of the trajectory with a cross-section, if $r(x_0)$ indicates that the trajectory will trace out the sequence 10001, and sequence 10000 is desired, then a search is made for the nearest bin to $x_0$ that will give this sequence, and this information is placed in M. (If the nearest bin is not unique, then there must be an agreement about which bin to take, for example, the bin farthest from the center of the loop.) Because the new starting point after a perturbation has a future evolution sequence that differs from the sequence followed by $x_0$ by at most the last bit, only two options need be considered at each intersection, control or no control. In an analog hardware implementation of the preferred embodiment, the perturbations are applied using voltage changes or current surges. In a software implementation of the preferred embodiment, the control matrix M would be stored along with the software computing the chaotic dynamics so that when a control perturbation is required, the information would be read from M.

A further improvement involves the use of microcontrols. For a preferred embodiment in software, each time a trajectory of the chaotic system passes through a cross-section, the simulation is backed-up one time step, and the roles of time and space are reversed in the Runge-Kutta solver so that the trajectory can be integrated exactly onto the cross-section without any interpolation. Then, at each intersection where no control is applied, the trajectory is reset so that it starts at the central point of whatever bin it is in. This resetting process can be considered the imposition of microcontrols. It removes any accumulation of round-off error and minimizes the effects of sensitive dependence on initial conditions. It also has the effect of restricting the dynamics of the chaotic attractor to a finite subset of the full chaotic attractor although the dynamics still visit the full phase space. These restrictions can be relaxed by calculating r(x) and M to greater precision at the outset.

The next step 22 in a preferred embodiment of the present invention is the imposition of a compressed initialization code on the chaotic system. The initialization code drives the chaotic system onto the periodic orbit that corresponds to the musical instrument. More specifically, the chaotic system is driven onto a periodic orbit by sending it a repeating code. Different repeating codes lead to different periodic orbits. For a large class of repeating codes, the periodic orbit reached is dependent only on the code segment that is repeated, and not on the initial state of the chaotic system (although the time to get on the periodic orbit can vary depending on the initial state). Consequently, it is possible to send an initialization code that drives the chaotic system onto a known periodic orbit.

These special repeating codes lead to unique periodic orbits for all initial states, so that there is a one-to-one association between a repeating code and a periodic orbit. However, for some repeating codes, the periodic orbits themselves change as the initial state of the chaotic system changes. Consequently, repeating codes can be divided into two classes, initializing codes and non-initializing codes. The length of each periodic orbit is an integer multiple of the length of the repeating code. This is natural, since periodicity is attained only when both the current position on the cross-section as well as the current position in the repeating code is the same as at some previous time. To guarantee that the chaotic system is on the desired periodic orbit, it is sufficient that the period of the orbit is exactly the length of the smallest repeated segment of the initializing code. Otherwise, it is possible that the chaotic system could be on the correct periodic orbit, yet out of phase. Nevertheless, for the music application, this would not be a problem as the human ear is not generally able to perceive the initial phase of a note.

The number of initializing codes has been compared with the number of bits used in the initialization code, and, it appears that the number of initializing codes grows exponentially. This is a promising result, since it means that there are many periodic orbits from which to choose.

Figure 5:
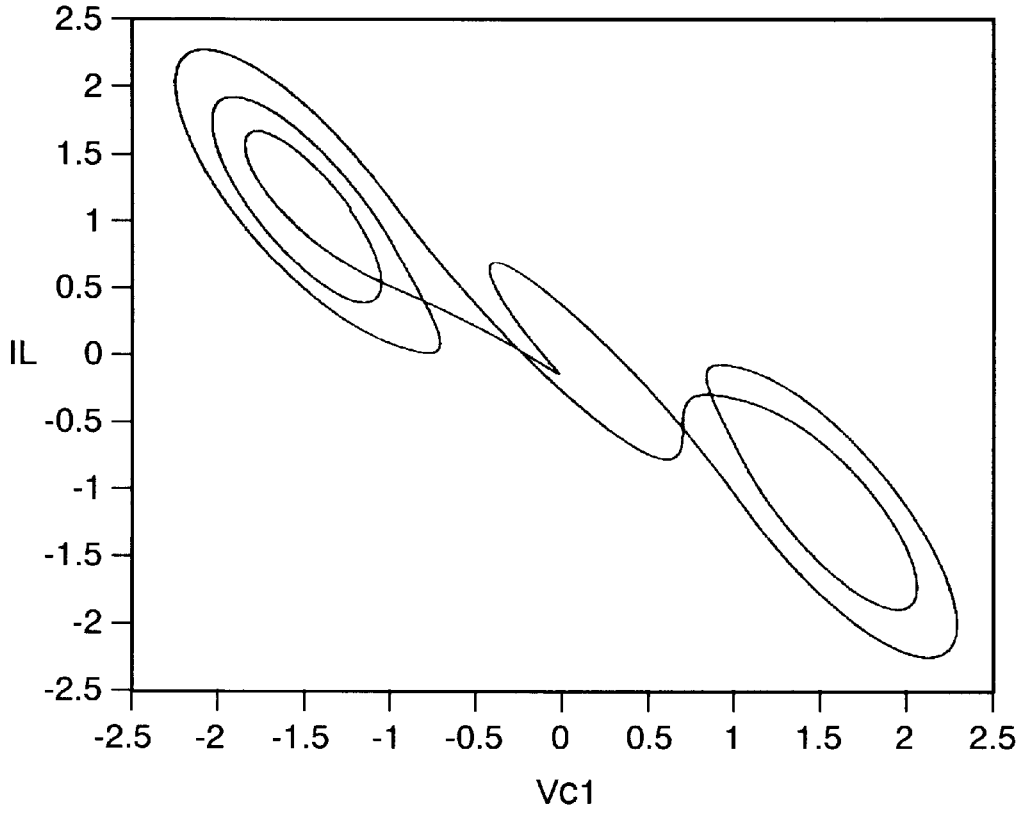
FIG. 5 is a plot of the periodic orbit of the double scroll oscillator resulting from a 5-bit initialization code (01011).

The compressed initializing code 01011 was repeated for the double-scroll oscillator of a preferred embodiment. The chaotic dynamics in FIG. 3 are driven onto the periodic orbit shown in FIG. 5, which periodic orbit is stable.

The next step 24 in a preferred embodiment of the present invention is generating a one-dimensional, periodic waveform by taking the x-, y-, or z-component (or a combination of them) of the periodic orbit over time. This periodic waveform represents an analog version of the desired note.

The next step 24 in the preferred embodiment of the present invention is sampling the waveform produced by the periodic orbit at a sampling rate that produces the desired frequency, and repeating the waveform to produce the desired duration, of a musical note. The waveform has a rich harmonic structure corresponding to the musical instrument. In order for a musical piece to sound coherent, each note must be based at the frequencies corresponding to the key signature and note of the scale, e.g. the note written "A" in the middle of the treble clef is commonly set at 440 Hz. When a note to be synthesized calls for an "A" of a particular duration, the musical waveform is generated using the appropriate initialization code, then the waveform is sampled at whatever sampling rate, and for whatever duration, is required to achieve the desired "A" note.

Since the equations governing the chaotic system in a preferred embodiment represent a continuous dynamical system, one can sample the periodic waveform as rapidly as may be desired. It suffices to take a short sample of the periodic waveform at a fixed sampling rate $\sigma$, calculate the Fast Fourier Transform, and from the spectrum determine the root frequency and harmonic structure of the note. This root frequency is compared to the frequency needed to produce the note in the score, and the correct sampling frequency to produce the desired note is computed by calculating the ratio $\mu$ of the desired frequency over the root frequency. The sampling rate necessary to produce a note of the desired frequency is $\sigma\mu$.

The final data can be produced in a number of ways. Once the sampling rate is found, the easiest approach is to take the rapidly sampled data and interpolate through the data at the new sampling rate using linear interpolation. A second approach is to recalculate the periodic waveform with the desired sampling frequency. A third approach is to apply frequency-based techniques to interpolate and decimate to achieve the desired sampling rate. Numerous other approaches to resampling can be applied. The particular approach chosen will depend on the particular application, and will require only techniques which are known to one skilled in the art. Once the resampled data is calculated, the musical note for that instrument is complete.

The next step 26 in a preferred embodiment of the present invention is converting the output of the digital sampling to a music file. Any one of a number of audio conversion packages known to one skilled in the art can be used to convert the output of the digital samples into a music file in a standard audio format, e.g., .au or .wav files.

In a preferred embodiment of the present invention, synthesis of music can be as simple as inputting a music score into a computer. A software program reads in a music score in a particular format and converts it into the control codes necessary to invoke compressed chaotic music synthesis. The input file consists of a header and score sections. The header contains information about a number of periodic orbits corresponding to various musical instruments and the associated initialization code for each orbit, as well as a line indicating the number of beats per minute and the note that gets the beat (eighth note, quarter note, half note, etc.). The score section is divided roughly as a typical musical score, with an indicator for breaks in the measure, and the symbols t, s, e., q, h, w representing thirty-second notes, sixteenth notes, eighth notes, quarter notes, half notes and whole notes, respectively. To make any of the notes into their "dotted" version, e.g., a dotted quarter note, one need only prepend the symbol d to the note. To set the note frequency, the preferred embodiment uses the actual frequency, e.g., A=440 Hz, so that the compression technique can allow for more abstract musical forms than those typically associated with the standard 12 semitone scale. However, another embodiment gains further compression by allowing only the twelve semitones. In each measure, the various instruments would have their separate parts typed into the input file. The score section would end when all of the instruments and all of the measures are input.

Other embodiments would provide other means to enter essentially the same information, such as software to convert a scanned score into the correct software format or a front-end graphical user interface to allow a composer to enter a music score on-screen. In any embodiment, the music score is simply developed in the traditional manner and then synthesized.

The input file is then converted into a compressed control code. The compressed control code takes each note for a given instrument and places the necessary information for note regeneration in a 32-bit word in memory. Each word is roughly divided into 8 bits for the note frequency, 16 bits for the control code or volume and instrument information, and 8 bits for the note duration (eighth note, quarter note, etc.). The header section at the beginning of the compressed control code contains something less than around 192 bits, so the overhead is negligible compared to a typical music file.

The method and apparatus of the present invention can be implemented entirely in software. The chaotic systems in such an implementation are defined by a set of differential equations governing the chaotic dynamics, e.g, the double scroll equations described above. The software utilizes an algorithm to simulate the evolution of the differential equations, e.g., the fourth order Runge-Kutta algorithm.

The chaotic systems can also be implemented in hardware. The chaotic systems are still defined by a set of differential equations, but these equations are then used to develop an electrical circuit that will generate the same chaotic dynamics. The procedure for conversion of a differential equation into an equivalent circuit is well-known and can be accomplished with analog electronics, microcontrollers, embedded CPU's, digital signal processing (DSP) chips, or field programmable gate arrays (FPGA), as well as other devices known to one skilled in tie art, configured with the proper feedbacks. The control information is stored in a memory device, and controls are applied by increasing voltage or inducing small current surges in the circuit.

The potential applications of the present invention for music synthesis are numerous. In many areas, digital multimedia presentations have become standard. The problem with such presentations is that the storage space dedicated to music is quite large, and every bit dedicated to music is unavailable for graphics. Most computer games on the market have limited musical soundtracks as the developers of these games put a premium on attaining better graphics. Using the present invention will allow the developers both to achieve better music and to free-up bits for improved graphics. A game manufacturer can offer users a "plug-in" that will take the compressed music files and expand them into full music tracks. Any games produced by the manufacturer will be able to call on the compressed chaotic music technology, so the CD-ROM games themselves will only save the fully compressed versions of the musical score.

A related application will allow the development of new sound-generation technology for video games such as NINTENDO and PLAYSTATION. A software embodiment of the present invention has the benefit that only a few differential equations are required to create the musical waveforms. It is possible to remove all of the instrument sampling that is generally associated with MIDI-like sound generation, which will allow the removal of the hardware associated with the music generation. Because the chaotic systems can generate the musical waveforms, it is not necessary to have specialized hardware to achieve the same result.

The algorithmic complexity of the compressed chaotic music synthesis is so low that it should be possible to develop handheld devices designed to compete for the market of MP3 players. Music produced by compressed chaotic synthesis will have such a high compression ratio that many hours of music can be stored on a handheld device equipped with the same amount of storage as a typical MP3 player.

Electronic karaoke boxes contain musical scores for many different pieces of music. Using the present invention, the music can be compressed so much that it will be possible to include a far greater repertoire than would be available by other means. Further, since the waveform generation is particularly simple for the compressed chaotic music synthesis, the hardware savings can again be substantial. It is not unreasonable to think that 1000 hours of music can be encoded into the storage needed for one CD-ROM.

In the area of Internet delivery of music, the compressed chaotic music synthesis of the present invention can be combined with the related technology of secure chaotic communication to solve a number of problems. First, the ability to compress large audio files will dramatically reduce the download times that currently plague users. Users will simply use the decompression "plug-in" to expand the file to produce a CD-quality audio file. If a 5 Mbyte CD-quality audio file takes 5 minutes to download in uncompressed mode, the same file produced using compressed chaotic synthesis (assuming a 1000-to-1 compression) will take only 0.3 of a second to download. Second, another problem that has hampered the Internet distribution of music is the problem of assuring appropriate compensation. To mitigate this problem, the compressed music files can be distributed using a secure chaotic communication link. The compressed music file represents the digital message that will be encoded using the chaotic communication scheme. Further, each user will be given a unique receiver so that he will not even be able to replay copies of a friend's downloaded files. It will also be possible for the file to change the state of the receiver so that the music file can be played only once. The marriage of these techniques may make it feasible to develop profitable online distribution networks for the music industry.

The use of compressed, chaotic music synthesis will also make it possible to develop much higher quality radio streaming over the Internet. This can be implemented in a number of ways, the simplest of which will be for all of the music files to be sent out by the radio station in compressed format, with the DJ voice-over being transmitted in its current format. Then, each receiver will have a real-time decompression "plug-in" to buffer the downloaded music stream, then decompress and play the music files. Various other implementations can be developed depending on whether it is important to compress the DJ voiceover in real time as well.

The present invention has been particularly shown and described above with reference to various preferred embodiments, implementations and applications. The invention is not limited, however, to the embodiments, implementations or applications described above, and modification thereto may be made within the scope of the invention.

What is claimed is:

1. A method for compressed chaotic music synthesis, comprising:

choosing a chaotic system with a periodic orbit whose harmonic structure approximates that of a selected musical instrument;

sending an initialization code to the chaotic system to drive the chaotic system onto the periodic orbit;

generating a periodic waveform from the periodic orbit;

producing an output by digitally sampling the periodic waveform for the frequency and duration of a note; and converting the output to a music file in a standard audio format.

2. The method for compressed chaotic music synthesis of claim 1 wherein the chaotic system is defined by a set of differential equations.

3. The method for compressed chaotic music synthesis of claim 1 wherein the chaotic system is defined by an electrical circuit.

4. A system for compressed chaotic music synthesis, comprising:

means for choosing a chaotic system with a periodic orbit whose harmonic structure approximates that of a selected musical instrument;

means for sending an initialization code to the chaotic system to drive the chaotic system onto the periodic orbit;

means for generating a periodic waveform from the periodic orbit;

means for producing an output by digitally sampling the periodic waveform for the frequency and duration of a note; and means for converting the output to a music file in a standard audio format.

5. The system for compressed chaotic music synthesis of claim 4 wherein the chaotic system is defined by a set of differential equations.

6. The system for compressed chaotic music synthesis of claim 4 wherein the chaotic system is defined by an electrical circuit.

7. A method for compressed chaotic music synthesis, comprising:

choosing a first chaotic system with a first periodic orbit whose harmonic structure approximates that of a selected musical instrument;

sending an initialization code to the first chaotic system to drive the first chaotic system onto the first periodic orbit;

generating a first periodic waveform from the first periodic orbit;

producing a first output by digitally sampling the first periodic waveform for the frequency and duration of a note;

converting the first output to a compressed control code;

transmitting the compressed control code to a second chaotic system, substantially similar to the first chaotic system, to drive the second chaotic system onto a second periodic orbit, substantially similar to the first periodic orbit;

generating a second periodic waveform from the second periodic orbit;

producing a second output by digitally sampling the second periodic waveform for the frequency and duration of the note; and converting the second output to a music file in a standard audio format.

8. A system for compressed chaotic music synthesis, comprising:

means for choosing a period orbit whose harmonic structure approximates that of a musical instrument;

means for sending an initialization code to a chaotic system to drive it onto the periodic orbit;

means for generating a periodic waveform from the periodic orbit;

means for sampling the periodic waveform for the frequency and duration of a note; and means for producing a compressed control code.

* * * * *

UNITED STATES PATENT AND TRADEMARK OFFICE

CERTIFICATE OF CORRECTION

PATENT NO. : 6,137,045 
DATED : October 24, 2000
INVENTOR(S) : Kevin M. Short, Dan Hussey and Kimo Johnson It is certified that error appears in the above-identified patent and that said Letters Patent is hereby corrected as shown below:

Title page,
Item [60], Related U.S. Application Data, insert -- Continuation-in-Part of US application No. 09/436,910, November 9, 1999. -- after "Provisional application No. 60/107,937, Nov. 12, 1998.".

Signed and Sealed this

Sixth Day of September, 2005

JON W. DUDAS
*Director of the United States Patent and Trademark Office*